US007325420B2

(12) United States Patent
Dort et al.

(10) Patent No.: US 7,325,420 B2
(45) Date of Patent: Feb. 5, 2008

(54) EXPANDABLE KNITTED NET

(75) Inventors: Thomas Dort, Wichita, KS (US); James Flick, Wichita, KS (US); Mike DeWeese, Kingman, KS (US); Lyndie Henrie, Kaysville, UT (US); Dennis Gregory McCabe, Kingman, KS (US); Paul Schmidt, Pretty Prairie, KS (US); Nick Carter, Mooresville, NC (US)

(73) Assignee: Polymer Group, Inc., Charlotte, NC (US)

( * ) Notice: Subject to any disclaimer, the term of this patent is extended or adjusted under 35 U.S.C. 154(b) by 0 days.

(21) Appl. No.: 11/704,114

(22) Filed: Feb. 8, 2007

(65) Prior Publication Data

US 2007/0193307 A1 Aug. 23, 2007

Related U.S. Application Data

(62) Division of application No. 10/971,181, filed on Oct. 22, 2004, now Pat. No. 7,188,494.

(60) Provisional application No. 60/513,280, filed on Oct. 22, 2003, provisional application No. 60/513,348, filed on Oct. 22, 2003.

(51) Int. Cl.
*D04B 21/20* (2006.01)

(52) U.S. Cl. ..... 66/193; 66/195

(58) Field of Classification Search ..... 66/192, 66/193, 195, 196

See application file for complete search history.

(56) References Cited

U.S. PATENT DOCUMENTS 4,228,566 A * 10/1980 Matsuda ..... 24/393
4,248,064 A * 2/1981 Odham ..... 66/192
4,320,634 A * 3/1982 Hashimoto et al. ..... 66/202
4,569,439 A * 2/1986 Freye et al. ..... 206/83.5
4,570,789 A * 2/1986 Fritz et al. ..... 206/83.5
4,781,291 A * 11/1988 VanGinhoven ..... 206/83.5
5,104,714 A * 4/1992 Leiber et al. ..... 428/131
5,256,353 A * 10/1993 Leiber et al. ..... 264/103
5,290,619 A * 3/1994 Siegel et al. ..... 428/102
5,457,968 A * 10/1995 McClintock et al. ..... 66/202
5,472,766 A * 12/1995 Siegel et al. ..... 428/102
5,601,907 A * 2/1997 Matsumoto ..... 442/1
6,141,993 A * 11/2000 Whitbeck ..... 66/195
6,477,865 B1 * 11/2002 Matsumoto ..... 66/195
6,521,551 B1 * 2/2003 Mass et al. ..... 442/1
6,630,414 B1 * 10/2003 Matsumoto ..... 442/1
6,840,067 B2 * 1/2005 Mass et al. ..... 66/203

* cited by examiner

*Primary Examiner*—Danny Worrell
(74) *Attorney, Agent, or Firm*—Kilyk & Bowersox, PLLC; Valerie Calloway

(57) ABSTRACT

The present invention is directed to a knitted net, and more specifically to an expandable knitted net. In one form, the net comprises a plurality of fill yarns with an elastomeric performance, which allows the net to expand in the cross-direction. In another form, the present invention is directed to a netting, and more specifically to a knitted netting comprising a plurality of chain yarns with dissimilar elongation performance oriented in a first direction, and a plurality of fill yarns oriented in a second direction, wherein the yarns oriented in the second direction secure the yarns oriented in the first direction in position within the netting.

10 Claims, 5 Drawing Sheets

EXPANDABLE KNITTED NET

CROSS-REFERENCE TO RELATED APPLICATION

This application is a division of U.S. Ser. No. 10/971,181, filed Oct. 22, 2004, now U.S. Pat. No. 7,188,494 B2, which claims the benefit of priority Provisional Applications No. 60/513,280, and No. 60/513,348, both filed on Oct. 22, 2003, the disclosures of which are incorporated herein by reference.

TECHNICAL FIELD

The present invention generally relates to a net, and more specifically to an expandable knitted net comprising a plurality of fill yarns with elastomeric properties that allows the net to expand in the cross-direction, or a plurality of chain yarns with dissimilar elongation performance.

BACKGROUND OF THE INVENTION

Netting is often prepared either by knitting, weaving, or extrusion. Knitted netting typically comprises a plurality of threads oriented in a first direction and being essentially equal spaced from one another, and having wefts oriented in a second direction which is perpendicular to the first direction, the threads and wefts being interlocked and secured. Nets may be prepared by a Raschel knitting method, a process in which the threads are attached to knitting elements that comprise two needles and knock-over comb bars positioned opposite to one another, and comprising ground guide bars, pattern guide bars and stitch comb bars. An example of such a knitted net is described in European Patent No. 0 723 606, to Fryszer, et al., incorporated herein by reference.

Knitted netting has a variety of end use applications, including but not limited to hay bale wrap, cargo wrap, netted bags, and drainage nets. Raschel knitted nets have been used for round hay bale wrapping as disclosed in U.S. Pat. Nos. 4,569,439 and 4,570,789, both hereby incorporated by reference. Twines and films have also been used to tie up hay bales; however the twine usually cuts in the bale and doesn't provide ample support to keep the bale tidy and neat. Further, the twining of the rolled bales with the binding yarn is relatively time-consuming and requires substantial manual labor. Film covers don't allow the rolled bale enough air circulation, which lead to the growth of mold and eventually rotting. The Raschel knitted net doesn't cut into the hay bale and allows ample amount of air to circulate through the bale. Although Raschel knitted netting has several advantages over twine and plastic film, the netting tends to shrink in overall width when pulled lengthwise. Due to the shrinkage in the width, the outer most edges of the hay bale are left exposed, which can cause the bale to become disheveled during pick-up and transport.

There is an unmet need for a net that will provide maximum coverage to a rounded bale maintaining the rolled bale compact shape during pick-up and transport, as well as during storage.

SUMMARY OF THE INVENTION

The present invention is directed to a knitted net, and more specifically to an expandable knitted net. In one form, the net comprises a plurality of fill yarns with an elastomeric performance, which allows the net to expand in the cross-direction. In another form, the present invention is directed to a netting, and more specifically to a knitted netting comprising a plurality of chain yarns with dissimilar elongation performance oriented in a first direction, and a plurality of fill yarns oriented in a second direction, wherein the yarns oriented in the second direction secure the yarns oriented in the first direction in position within the netting.

In accordance with the present invention, the netting is used as bale wrap. In one form, the bale wrap comprises a plurality of chain yarns orientated in a first direction and a plurality of fill yarns orientated in a second direction. The elastomeric performance of the fill yarns provide for optimal coverage of the bale upon stretching of the netting. When stretched in the cross-direction, the netting easily conforms about the shape of a rolled bale, hugging the surface so as to maintain the compact nature of the rolled bale. In another form of the present invention, the netting is used as bale wrap. The bale wrap comprises a plurality of chain yarns oriented in a first direction, wherein the yarns have dissimilar elongation performances. The dissimilar elongation performances of the yarns provide for optimal coverage of the bale upon stretching of the netting. In order to achieve the desired necking performance when stretching the netting, the yarns located proximal to either edge have a higher elongation performance than those located distal to the outer edges Upon stretching, those yarns located proximal the outer edges stretch further than those located distal to the outer edges. This causes the outer edge of the net to flair, allowing the net to fold over the edges of the hay bale, maintaining the compact nature of the rolled bale.

The yarns of the present invention may comprise flat filaments, such as tapes, mono-filaments, or a combination thereof. The filaments may be of similar or dissimilar polymeric compositions. Suitable filaments, which may be blended in whole or part with natural or synthetic polymeric compositions, include polyamides, polyesters, polyolefins, polyvinyls, polyacrylics, and the blends or coextrusion products thereof. The synthetic polymers may be further selected from homopolymers; copolymers, conjugates and other derivatives including those thermoplastic polymers having incorporated melt additives or surface-active agents.

It is within the purview of the present invention that the fill yarns comprise a varying degree of elasticity. For instance, it has been contemplated that the fills yarns located proximal to the outer edges comprise greater elasticity than those fill yarns located distal to the outer edges of the net. The dissimilarities in the elasticity performance of the fill yarns can establish specific zones within the netting. A zone is defined as an area within the netting that is comprised of more than one chain yarn and more than one fill yarn, whereby the fill yarns have a similar elasticity performance. The netting may be comprised of two or more zones. Further, the yarns of one zone may comprise similar or dissimilar yarns than that of a second zone. Further still, the yarns of one zone may comprise similar or dissimilar topical or internal additives than that of a second zone.

The yarns of the present invention may comprise flat filaments, such as tapes, mono-filaments, or a combination thereof. The filaments may be of similar or dissimilar polymeric compositions. Suitable filaments, which may be blended in whole or part with natural or synthetic polymeric compositions, include polyamides, polyesters, polyolefins, polyvinyls, polyacrylics, and the blends or coextrusion products thereof. The synthetic polymers may be further selected from homopolymers; copolymers, conjugates and other derivatives including those thermoplastic polymers having incorporated melt additives or surface-active agents.

It is within the purview of the present invention that the chain yarns of dissimilar elongation orientated in the first direction, establish specific zones within the netting. A zone is defined as an area within the netting that is comprised of more than one chain yarn having similar elongation performance. The netting is comprised of at least three zones, wherein the zones located proximal to the outer edges comprise a greater elongation performance than the zones located distal to the outer edges. Further, the chain yarns of one zone may comprise similar or dissimilar chain yarns than those of a second zone. Further still, the chain yarns of one zone may comprise similar or dissimilar topical or internal additives than those of a second zone.

DETAILED DESCRIPTION

While the present invention is susceptible of embodiment in various forms, there will hereinafter be described, presently preferred embodiments, with the understanding that the present disclosure is to be considered as an exemplification of the invention, and is not intended to limit the invention to the specific embodiments disclosed herein.

In accordance with the present invention, the expandable knit is formed on a Raschel knitting machine. The machine comprises a plurality of latch needles, a plurality of lapping belts, a yarn laying-in comb and a plurality of guide bars having needle guides thereon. The latch needles are mounted in the machine to carry out a reciprocating motion in a given plane while the lapping belts are spaced from the needles on one side of the plane, i.e., on a downstream side, for guiding pattern yarns to the needles. In addition, the laying-in comb is mounted on the same side of the plane of the latch needles as the lapping belts and carries out an orbital motion perpendicularly of the plane of the latch needles to penetrate between the pattern yarns. The guide bars with the needle guides serve to lay-in stitch yarns and are mounted on an opposite side of the plane of the latch needles from the lapping belts, i.e. on the upstream side, and oscillate at an angle to the pattern yarns.

Figure 1:
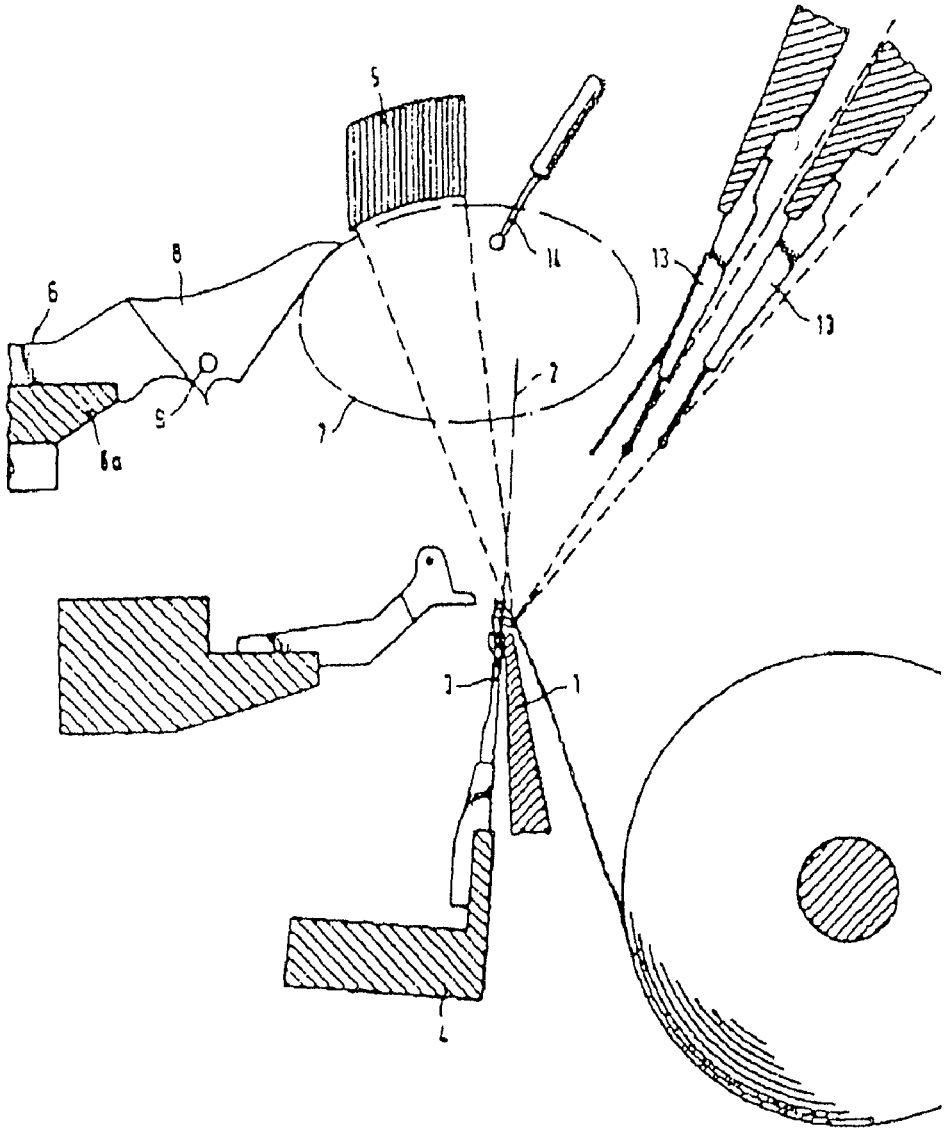
FIG. 1 illustrates a view of a portion of a Raschel machine.

FIG. 1, is representative of a Raschel machine, whereby it is provided with a comb plate 1 in which a plurality of latch needles 3 are mounted for reciprocating motion along their axes 2 in a vertical plane, as viewed. As shown, the needles 3 are disposed on a bar 4 which is movable up and down.

In addition, the machine includes a plurality of lapping belts or guide bars 5 spaced from the needles 3 on one side, i.e. the downstream side, of the plane of the needles 3 for guiding pattern yarns to the needles 3. A yarn laying-in comb 6 is also mounted on the same side of the plane 2 of the latch needles 3 in order to carry out an orbital motion perpendicularly of the plane 2 while penetrating between the pattern yarns. As indicated in chain-dotted line 7, the orbital motion is a combined stroke and oscillating motion. The comb 6 is provided with a plurality of parallel sinkers 8 each of which carries a guide rod 9 and which has a deflecting edge 10 at the forward end extending towards the plane 2. In addition, each sinker 8 has a yarn catch 11 at a lower region of the deflecting edge 10 below the guide rod 9. A trace comb 12 is also mounted over the comb plate 1 in known manner.

The machine also has a plurality of guide bars 13 which have needle guides thereon for directing stitch yarns to the latch needles 3. As shown, the guide bars 13 are mounted on the side of the plane 2 of the latch needles 3 opposite the lapping belts 5, i.e., on the upstream side. Suitable means are also provided for oscillating the guide bars 13 at an angle to the pattern yarns.

As shown in FIG. 1, the lapping belts 5 are positioned at an acute angle downstream of the plane 2. A yarn guide 14 is also disposed between the belts 5 and the guide bars 13 for deflecting the pattern yarns upon laying-in of the stitch yarns. This yarn guide 14 is used for laying the pattern yarns in the needle lanes (not shown). The yarn guide 14 may be coupled to the guide bars 13 so as to move therewith or may be provided with an independent drive (not shown).

The netting of the present invention is knitted on such a machine, wherein in one form a plurality of chain yarns are orientated in a first direction and a plurality of elastomeric fill yarns are orientated in a second direction. Elastomeric fill yarns may be utilized in entirety or in part throughout the net. Further, the elastic fill yarns may be of varying degrees of elasticity. It is also in the purview that the net comprise zones, wherein a zone is characterized by its degree of elasticity or complete lack thereof. The chain yarns are interconnected with fill yarns orientated in a second direction on a Raschel machine forming a net, wherein the net exhibits the ability to expand in the cross-direction.

In another form of the invention, the netting of the present invention is knitted on such a machine, wherein at least three chain yarns of a first elongation performance are orientated in a first direction and at least two chain yarns of a second elongation performance orientated in said first direction. The chain yarns of a first elongation performance are arranged into two zones, wherein each zone is located proximal to an outer edge. Chain yarns of a said second elongation performance are arranged into a separate zone and the zone is located distal to the outer edges or intermediate the two proximal zones. The chain yarns are interconnected with fill yarns orientated in a second direction on a Raschel machine forming a net, wherein the net exhibits differential elongation.

Figure 2:
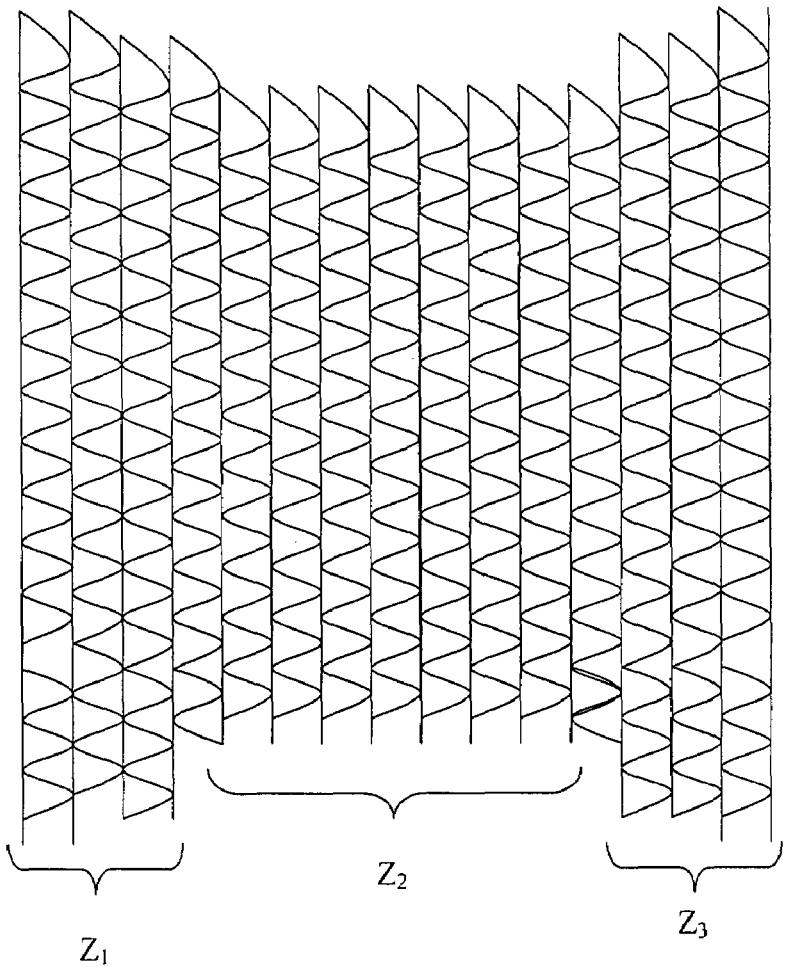
FIG. 2 is a representation of the zones within the net of the present invention while the net is in a relaxed state, which zones can be provided in differentially elongated netting.

Referring to FIG. 2 therein is a diagrammatic representation of the knitted net of the present invention in a relaxed state. In one form, the net of FIG. 2 comprises three zones, wherein zone one ($Z_1$) has a greater elasticity performance than zone two ($Z_2$) and zone three ($Z_3$) has a greater elasticity performance than zone two ($Z_2$). Upon stretching, the net exhibits differential expansion in the cross-direction. It's in the purview of the present invention that the yarns of one zone may comprise similar or dissimilar yarns than that of a second zone. Further still, the yarns of one zone may comprise similar or dissimilar topical or internal additives than yarns of a second zone.

In another form, the net comprises at least three zones, wherein zone one ($Z_1$) has a greater elongation performance than zone two ($Z_2$) and zone three ($Z_3$) has a greater elongation performance than zone two ($Z_2$). Preferably, the zones located most proximal to the outer edges have an elongation performance at least 110% greater, more preferably 120% greater, and most preferably 130% greater than the zone(s) located distal to the outer edges.

Figure 3:
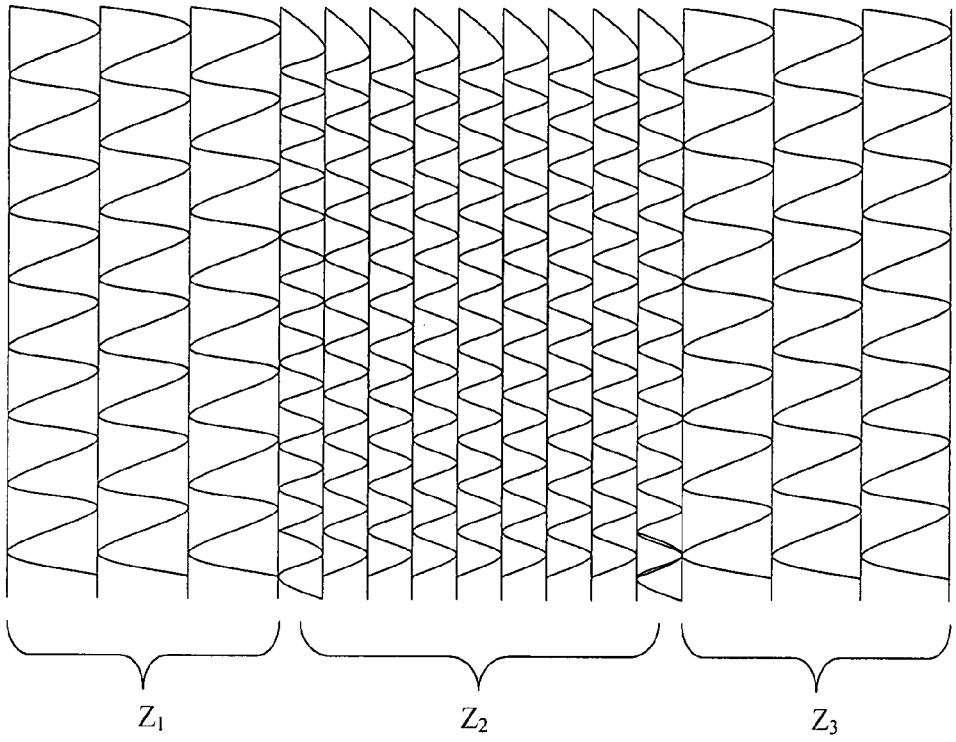
FIG. 3 is a representation of the zones within the net of the present invention while the net is in a stretched state.
Figure 4:
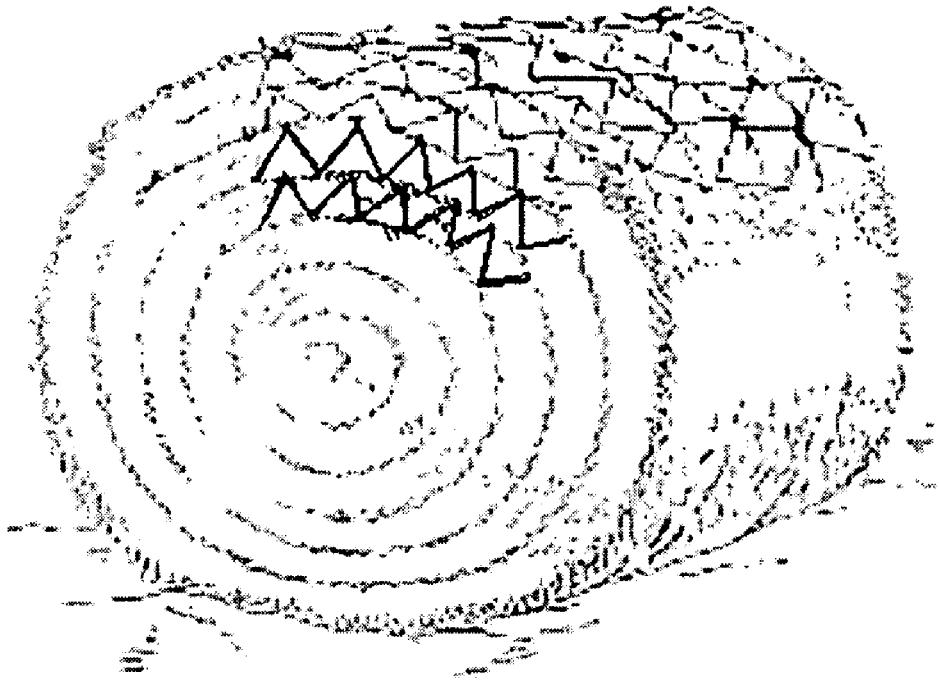
FIG. 4 is a diagrammatic view of the netting partially wrapped about a rounded bale.
Figure 5:
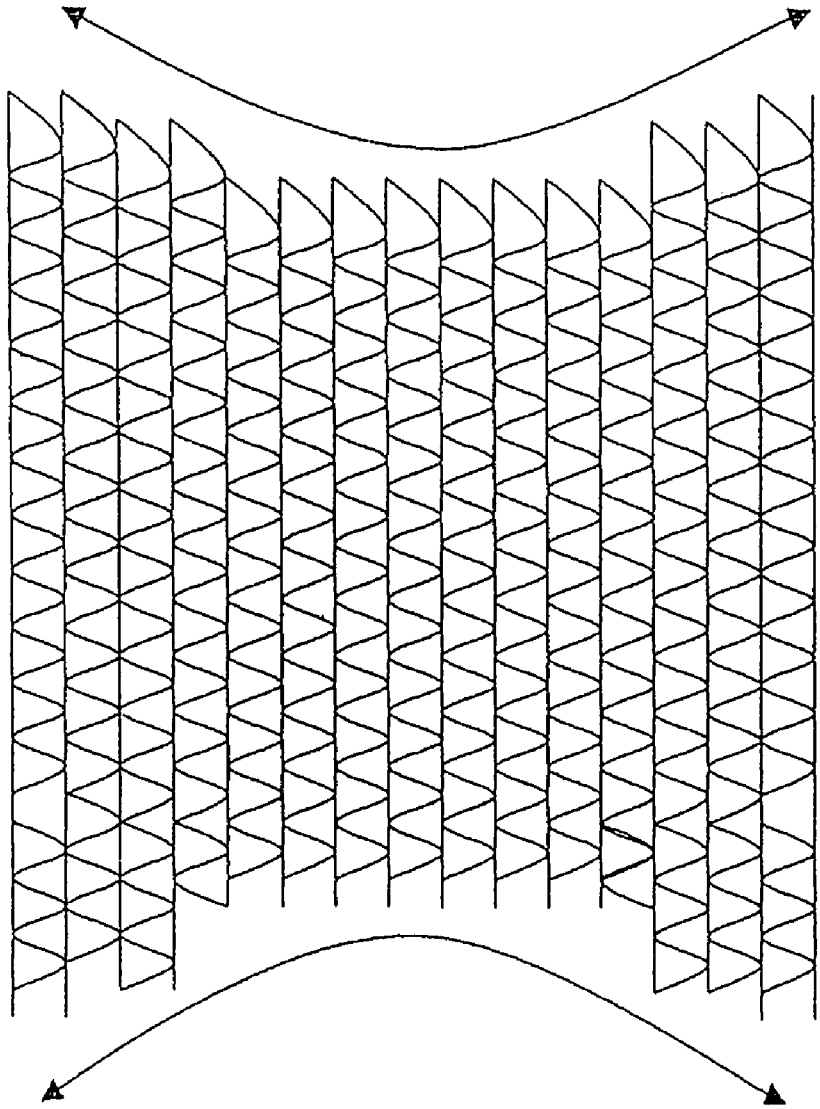
FIG. 5 is a diagrammatic view of differentially elongated netting.

FIG. 3 shows the netting once it is stretched. Due to the elasticity of the fill yarns, the net is able to expand in the cross-direction, easily conforming to the shape of a rolled bale and folding over the edges of the bale so as to prevent the bale from becoming disheveled along the ends. FIG. 4 demonstrates how the expandable net fits around the bale to keep it compact and neat.

It is within the purview of the present invention that the chain yarns of one zone may comprise similar or dissimilar chain yarns than those of a second zone. Further still, the chain yarns of one zone may comprise similar or dissimilar topical or internal additives than those of a second zone. It's also in the purview of the present invention that the fill yarns of one zone may comprise similar or dissimilar fill yarns than that of a second zone. Further still, the fill yarns of one zone may comprise similar or dissimilar topical or internal additives than fill yarns of a second zone.

FIG. 3 shows the necking that occurs once the netting is stretched. Due to the increase in elongation of the yarns located along the outer edges, the final net construct is capable of wrapping over the edges of the bale so as to prevent the bale from becoming disheveled along the ends. FIG. 4 demonstrates how the differentially elongated net fits around the bale to keep it compact and neat.

Subsequent to formation, the knitted net material may optionally be subjected to various chemical and/or mechanical post-treatments. The net material is then collected and packaged in a continuous form, such as in a roll form, or alternatively, the net material may comprise a series of weak points whereby desired lengths of twine material may be detracted from the remainder of the continuous packaged form.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making a knitted net with an elastomeric performance in the cross-direction comprising the steps of:

providing chain yarns orientated in a first direction;

providing fill yarns orientated in a second direction, wherein said fill yarns comprise a first elastomeric performance;

providing fill yarns orientated in a second direction, wherein said fill yarns comprise a second elastomeric performance;

arranging said fill yarns comprising a first elastomeric performance into a first zone;

arranging said fill yarns comprising a second elastomeric performance into a second zone; and interconnecting said chain yarns and said fill yarns on a Raschel machine forming a netting, wherein said netting exhibits differential expansion in the cross-direction.

2. A method of making a knitted net with an elastomeric performance in the cross-direction as in claim 1, wherein said net is comprised of at least thee zones.

3. A method of making a knitted net with differential elongation comprising the steps of:

providing at least three chain yarns of a first elongation performance orientated in a first direction;

providing at least three chain yarns of a second elongation performance orientated in said first direction;

providing fill yarns orientated in a second direction;

arranging said chain yarns of a said first elongation performance into two zones, wherein said zones are located proximal to the outer edges;

arranging said chain yarns of a said second elongation performance into a zone, wherein said zone is located distal to the outer edges; and interconnecting said chain yarns and said fill yarns on a Raschel machine forming a netting, wherein said netting exhibits differential elongation.

4. A method of making a knitted net with differential elongation as in claim 3, wherein said yarns are selected from the group consisting of polyamides, polyesters, polyolefins, polyvinyls, polyacrylics, and the combinations thereof.

5. A method of making a knitted net with differential elongation as in claim 4, wherein said yarns are polymeric tapes, filaments, or a combination thereof.

6. A method of making a knitted net with differential elongation as in claim 3, wherein said net is comprised of at least three zones.

7. A method of making a knitted net with differential elongation as in claim 6, wherein said zone comprises at least three chain yarns.

8. A method of making a knitted net with differential elongation as in claim 7, wherein said chain yarns are similar.

9. A method of making a knitted net with differential elongation as in claim 7, wherein said chain yarns are dissimilar.

10. A method of making a knitted net with differential elongation as in claim 3, wherein said net comprises a post-treatment.

* * * * *